United States Patent [19]

Kunimune et al.

[11] 4,211,819

[45] Jul. 8, 1980

[54] HEAT-MELT ADHESIVE PROPYLENE POLYMER FIBERS

[75] Inventors: Kohichi Kunimune; Seigo Inadomi; Satomi Yoshida, all of Moriyamashi, Japan

[73] Assignee: Chisso Corporation, Osaka, Japan

[21] Appl. No.: 908,678

[22] Filed: May 23, 1978

[30] Foreign Application Priority Data

May 24, 1977 [JP] Japan ..... 52-60016

[51] Int. Cl.[2] ..... D02G 3/00

[52] U.S. Cl. ..... 428/374; 428/296; 428/364; 428/369; 428/370; 428/373

[58] Field of Search ..... 428/373, 374, 364, 296, 428/369, 370; 264/171; 260/878; 526/348

[56] References Cited

U.S. PATENT DOCUMENTS

| | | | |
|---|---|---|---|
| 3,231,650 | 1/1966 | Findlay et al. | 428/296 |
| 3,276,944 | 10/1966 | Levy | 428/296 |
| 3,505,164 | 4/1970 | Oppenlander | 428/394 |
| 3,511,747 | 5/1970 | Davies | 156/181 |
| 3,595,731 | 7/1971 | Davies et al. | 428/296 |
| 3,639,195 | 2/1972 | Sanders | 156/62.2 |
| 3,900,678 | 8/1975 | Aishima et al. | 428/374 |

*Primary Examiner*—Lorraine T. Kendell
*Attorney, Agent, or Firm*—Fred Philpitt

[57] ABSTRACT

Heat-melt adhesive propylene polymer fibers which can be produced with a superior spinnability are provided, which comprise a resin consisting of (A) 50–100% by weight of a crystalline propylene terpolymer consisting of specified amounts of propylene, butene-1 and ethylene, and (B) 0–50% by weight of a substantially non-crystalline ethylene-propylene random copolymer; said fibers consisting of single fibers of said resin alone or composite fibers having said resin as one component thereof.

6 Claims, No Drawings

HEAT-MELT ADHESIVE PROPYLENE POLYMER FIBERS

DESCRIPTION OF THE INVENTION

The present invention relates to propylene polymer fibers which can be produced with a superior spinnability and are heat-melt adhesive fibers.

As for known heat-melt adhesive fibers of olefin polymers, polypropylene fibers, polyethylene fibers, composite fibers consisting of two composite components of polypropylene and polyethylene (which will be hereinafter abbreviated to PP-PE composite fibers), etc. are mainly mentioned. The former two are used as a binder in admixture with other materials, while the latter composite fibers not only can be of course used as binder fibers, but also it is possible to obtain non-woven fabrics or other various molded products of fibers from the composite fibers alone i.e. without blending them with other fibers, since they can cause heat-melt adhesion without losing their form even at the time of heat-treatment for effecting heat-melt adhesion.

These fibers, however, have the following drawbacks. As for polypropylene fibers, the spinnability of polypropylene at the time of melt-spinning is relatively excellent, but since its melting point is as somewhat high as 165° C., the available range as heat-melt adhesive fibers is narrow. As for polyethylene fibers, although polyethylene has a melting point of about 130° C., it is inferior in the spinnability to make it difficult to obtain fibers of small fibers therefrom. As for PP-PE composite fibers, spinnability is generally inferior as compared with the case where fibers of polypropylene alone (i.e. polypropylene fibers) are produced. As for olefin polymer fibers, since they have a high resistance to chemicals, their available value is high. Thus, heat-melt adhesive fibers of olefin polymers which are superior in the spinnability at the time of their production and have a lower heat-melt adhesive temperature, have been desired.

The present inventors have made strenuous studies in order to satisfy such a desire, and as a result have found that specified propylene polymers are much superior in the spinnability to usual polypropylene for fibers, and have attained the present invention based on this finding and by making use of their superior heat-melt adhesive property.

The present invention resides in:

Propylene polymer fibers consisting of a resin alone consisting of (A) 50–100% by weight of a crystalline propylene copolymer (which will be hereinafter often abbreviated to PP terpolymer) consisting of 84–98% by weight of propylene, 1–15% by weight of butene-1 and 1–10% by weight of ethylene, and (B) 0–50% by weight of a substantially non-crystalline ethylene-propylene random copolymer (which will be hereinafter often abbreviated to EPR); or having said resin as at least one composite component of said fibers, at least a portion of the surface of said fibers being formed by said resin.

The PP terpolymer is a solid polymer obtained by polymerizing propylene, butene-1 and ethylene in the presence of a usual Ziegler-Natta catalyst, so as to give the above-mentioned respective contents, and is essentially a random copolymer. Beside a method of polymerizing mixed gases from the beginning, it is also possible to employ a method wherein, for improving the productivity, 20% by weight or less of a polymer (% by weight will be hereinafter often abbreviated merely to %) based on the weight of the total polymer is in advance obtained by homopolymerization of propylene, followed by polymerization by feeding mixed gases of the respective components. If the contents of the comonomers (butene-1 and ethylene) contained in said copolymer are less than 1%, respectively, the spinnability and heat-melt adhesive property of the resulting fibers become insufficient. The content of ethylene has an influence above all upon the melting point of the copolymer, while the content of butene-1 has an influence above all upon the melting point and heat-melt adhesive property thereof. With the increase of the contents of the comonomers, the melting point of the copolymer decreases, and the heat-melt adhesive property increases, but, at the same time, the proportion of a by-product formed, soluble in the polymerization solvent (hydrocarbon) employed at the time of polymerization, increases to reduce the productivity of the copolymer. Thus those having higher contents than the above-mentioned upper limits with respect of the respective comonomers, or those having a lower content of propylene than the above-mentioned lower limit, are unsuitable for commercial production. The melting point of the PP terpolymer having the above-mentioned constitution of the components is in the range of 120°–150° C.

As for the ethylene content of EPR, the range of 30–80% is suitable.

As for the heat-melt adhesive raw material resins employed for the heat-melt adhesive fibers of the present invention (which will be hereinafter referred to as "raw material resins" of the present invention), the above-mentioned PP terpolymer is employed as a basic raw material resin, since it is much superior in the spinnability and also has a good heat-melt adhesive property. Further it is also possible to employ as a raw material resin of the present invention, a mixture of PP terpolymer with EPR in an amount up to 50%, preferably up to 30% based upon the total weight of the resulting mixture, since EPR alone has almost no spinnability, but it is superior in the heat-melt adhesive property and is good in the compatibility with PP terpolymer having a superior spinnability.

These raw material resins of the present invention form the surface of the resulting fibers and exhibit a good heat-melt adhesive property. Accordingly, not only fibers consisting singly of the raw material resins of the present invention (such fibers having not a composite structure but a uniform component structure will be hereinafter referred to as single fibers), but also side-by-side and sheath-and-core type composite fibers consisting of a high melting component and a low melting component, wherein the raw material resins of the present invention form at least a portion of the surface of the fibers, are included in the heat-melt adhesive fibers of the present invention. In case of the side-by-side composite fibers, the percent cross-sectional circumference of the low melting component consisting of the raw material resins of the present invention is preferably 50% or higher, more preferably 60% or higher.

In the case of the composite fibers, as for the other resin for the high melting component, to be combined with the above-mentioned raw material resin, those having a melting point higher than those of the resins of the present invention, by 20° C. or higher, are preferable, since the heat-treating processing of the composite fibers becomes easy. As for such resins, melt-spinnable polyamides, polyesters, etc. can be employed at least in the cases of sheath-and-core type or a side-by-side type close thereto, however even in the case of side-by-side type, polypropylene is most desirable since it has a peel-resistant property relative to the raw material resins of the present invention.

The production of the heat-melt adhesive fibers of the present invention can be carried out by means of usual melt-spinning apparatuses and stretching apparatuses for single or composite fibers. For smoothly carrying out this production, it is preferable that PP terpolymer has a melt flow rate (which will be hereinafter abbreviated to MFR; according to ASTM D-1238(L)) of 1–50, while EPR has a melt index (which will be hereinafter abbreviated to MI; according to ASTM D-1238(E)) of 1–30, however, in case where the production is carried out without any stretching as in case of spun bond system, those having values beyond the above-mentioned ranges can be employed.

As for the heat-melt adhesive fibers of the present invention, since the spinnability of the raw material resins of the present invention is much superior, it is possible to obtain fibers of small denier in case of single fibers. Further, they have a high available value as binder fibers or a raw material for heat-sealable paper, due to their low temperature heat-melt adhesive property.

Further, even in case of composite fibers, since the spinnability of the raw material resins of the present invention is much superior, it is possible, for example, in case of employing polypropylene as a high melting component, to obtain composite fibers in a superior spinnability as compared with composite fibers consisting, as the respective composite components, of polypropylene and polyethylene or polypropylene and an ethylene-vinyl acetate copolymer. Further, in case of side-by-side type composite fibers, the two components are very difficult to be peeled. Accordingly, even when they are used for carpets by making use of their heat-melt adhesive property, so-called chalk mark which occurs when composite fibers consisting, as two composite components, of polypropylene and polyethylene are employed, does not occur. Since they have a superior heat-melt adhesive property and adhere while maintaining the fiber form, it is possible for them to exhibit various feelings different from those in case where single fibers are employed as binder fibers.

Beside the above-mentioned various properties, the heat-melt adhesive fibers of the present invention have no solid and stiff feeling as in polypropylene fibers nor sticky feeling as in polyethylene fibers, but are soft and have a specific luster and a good feeling.

The present invention will be further illustrated by way of Examples and Comparative examples without limiting the scope of the present invention.

EXAMPLES 1–10 AND COMPARATIVE EXAMPLES 1–5

(i) Preparation of PP terpolymer

Polymerization was carried out employing a Ziegler-Natta catalyst, at a polymerization temperature of 40°–70° C., while continuously feeding a monomer mixture in a given proportion. As for copolymers excluding those of Examples 1 and 6 and Comparative example 3, a polypropylene segment corresponding to about 10% of polymer based on the weight of the total polymer was inadvance formed by feeding propylene gas alone, and successively, mixed monomers were fed to prepare a copolymer. The molecular weight of the copolymer was adjusted by means of hydrogen. After completion of the polymerization, the resulting polymer slurry was purified and washed with alcohol and water, and a hydrocarbon solvent-insoluble polymer was separated and dried, followed by adding small amounts of a phenolic antioxidant and a stearate salt, and granulation to obtain a raw material.

(ii) As for EPR, a commercially produced product on sale was employed.

(iii) Preparation of heat-melt adhesive fibers and fibers as comparative examples Usual single spinning or composite spinning was carried out. Stretching was selectively carried out in relation to spinning conditions. The temperature of resin melt was 300° C. in either case of raw material resins and polypropylene, while 200° C. in case of polyethylene. The nozzle employed had a hole diameter of 0.5–1.0 mm and a number of holes of 60–470. The data of the raw material resins and the spinning and stretching are shown in Table 1 and Table 2. Examples 1–6 and Comparative examples 1–3 illustrate the case of single fibers, while Examples 7–10 and Comparative examples 4–5 illustrate the case of composite fibers. In case of Example 8 and Comparative example 5, a blue pigment was blended with each of the raw material resins as the composite components, in an amount of 1%, followed by spinning. Among the examples of composite fibers, Example 9 alone is directed to sheath-and-core type composite fibers, and others are directed to side-by-side type composite fibers. The percents cross-sectional circumference of the low melting components of the side-by-side type composite fibers were all in the range of 50–80%. As apparent from Table 2, in case of spinning of single fibers of the present invention, the spinnability is much superior to those in the cases of usual polypropylene fibers or ethylene fibers.

(iv) Non-woven fabric-making test

In order to observe the adhesive effectiveness of the heat-melt adhesive fibers of the present invention, the following non-woven fabric-making test was carried out:

Employing some of the fibers obtained in the above-mentioned paragraph (iii), about 10 crimps per 25 mm were imparted to the fibers by means of a crimper, followed by cutting to staple fibers having a fiber length of 64 mm, blending therewith, rayon fibers having a fiber length of 51 mm and a thinness of 3d, and passing through a carding machine to form a web of about 50 g/m$^2$, which was then subjected to heat-melt adhesion through the low melting component by means of a calender roll to obtain a bulky non-woven fabric. As for the measurement of the strength of the non-woven fabric, a test piece having a width of 5 cm and a length of 15 cm was stretched at a constant rate of 10 cm/min, by means of an Instron tensile tester. Values obtained by dividing the resulting tensile strength by "Metsuke" (weight of fabric per unit area) were regarded as strength per Metsuke. The results are shown in Table 3. As evident from the Table, the heat-adhesive property of the heat-melt adhesive fibers of the present invention is superior.

(v) Paper-making test

Some of the fibers obtained in the above-mentioned paragraph (iii) were short-cut to fibers having a fiber length of 5 mm to obtain a raw material for paper-making. After blending of paper materials, paper-making was carried out according to the method of JIS P8209, followed by drying at a dryer temperature of 95° C. to obtain a synthetic fiber paper. The physical properties of this paper are shown in Table 4. According to this Table, the paper containing the heat-melt adhesive fibers of the present invention is particularly superior in the heat-sealability. The measurement methods for the items to be measured are as follows:

Breaking length

Measurement is carried out according to JIS P 8113. In case of wet state, measurement is carried out after immersion in water at 20° C., for 10 minutes.

$$\text{Breaking strength (Km)} = \frac{\text{Tensile strength}}{B \times W} \times 1000$$

B: Width of test piece (mm)
W: Weight per unit area, of test piece (g/m$^2$)

Peel strength of paper

A paper sample having a width of 15 mm and a length of 200 mm is folded to its half (width: 15 mm, length: 100 mm) and heat-sealed for a given time, under a pressure of 2.8 Kg/cm$^2$ by means of a heat-sealer set to a given temperature. The material is slightly peeled from one end of the adhered surface, and the peel strength is measured at a test length of 50 mm, at a tensile rate of 50 mm/min by means of an Instron tester.

Tensile strength of paper

A raw material paper having a width of 15 mm and a length of 200 mm is measured at a test length of 150 mm, at a tensile rate of 50 mm/min by means of an Instron tester.

(vi) Chalk mark test

Stretched yarns of Example 8 and Comparative example 5 (any of which contain 1% of a blue pigment) were given 10 crimps per 25 mm by means of a crimper and cut to staples having a fiber length of 64 mm. Each staple was passed through a carding machine to prepare a web of about 500 g/m$^2$, which was then needle-punched and subjected to heat-melt adhesion in a dryer set to 145° C. to prepare a carpet. When the surfaces of two carpets prepared according to the above-mentioned method were rubbed with a metal piece, the carpet prepared from the fibers of Comparative example 5 incurred white streaks (so-called chalk mark), but the fibers prepared from the fibers of Example 8 incurred no chalk mark.

Table 1

(Resins employed)

| | Single fibers | | | | | | |
|---|---|---|---|---|---|---|---|
| | PP terpolymer | | | | EPR | | |
| | Butene-1 content (%) | Ethylene content (%) | MFR | M.P. (°C.) | Ethylene content (%) | MI | Blending proportion (%) |
| Example 1 | 2.5 | 4.5 | 6.4 | 142 | — | — | — |
| Example 2 | 8.0 | 4.0 | 13.6 | 134 | — | — | — |
| Example 3 | 4.5 | 4.0 | 24.1 | 138 | — | — | — |
| Example 4 | 13.2 | 1.1 | 4.6 | 131 | — | — | — |
| Example 5 | 4.5 | 8.3 | 4.9 | 123 | — | — | — |
| Example 6 | 2.5 | 4.5 | 6.4 | 142 | 77 | 20 | 20 |
| Comparat. ex. 1 | Polypropylene (MFR 6.2) | | | | | | |
| Comparat. ex. 2 | High density polyethylene (MI 8.3) | | | | | | |
| Comparat. ex. 3 | Ethylene-propylene copolymer (Ethylene content: 2.1%, MFR: 6.1, M.P.: 154° C.) | | | | | | |

| | Composite fibers | | | | | | | | |
|---|---|---|---|---|---|---|---|---|---|
| | Low melting component (A) | | | | | | | | |
| | PP terpolymer | | | | EPR | | | | |
| | Butene-1 content (%) | Ethylene content (%) | (MFR) | M.P. (°C.) | Ethylene content (%) | MI | Blending proportion (%) | High melting component (B) | Composite ratio (A)/(B) (by weight) |
| Example 7 | 8.0 | 5.2 | 28.8 | 129 | — | — | — | Polypropylene (MFR 6.2) | 50/50 (side-by-side) |
| Example 8 | 12.7 | 2.2 | 37.1 | 130 | — | — | — | Polypropylene (MFR 6.2) | 50/50 (side-by-side) |
| Example 9 | 8.0 | 5.2 | 28.8 | 129 | — | — | — | Polypropylene (MFR 11.8) | 50/50 (sheath-and-core) |
| Example 10 | 8.0 | 5.2 | 28.8 | 129 | 75 | 4.7 | 30 | Polypropylene (MFR 6.2) | 50/50 (side-by-side) |
| Comparat. ex. 4 | Low density polyethylene (MI 25.1) | | | | | | | Polypropylene (MFR 6.2) | 50/50 (side-by-side) |
| Comparat. ex. 5 | Low density polyethylene (MI 25.1) | | | | | | | Polypropylene (MFR 6.2) | 50/50 (side-by-side) |

Table 2

(Spinning and stretching data)

| Example Comparative ex. | Spinning condition: Extrusion amount (g/min) | Number of nozzle hole | Take-up speed (m/min) | Denier of unstretched yarns | Spinnability | Stetching condition: Stretching temperature (°C.) | Stretching times | Denier of stretched yarns | Stretchability |
|---|---|---|---|---|---|---|---|---|---|
| Ex. 1 | 30 | 450 | 800 | 0.75 | good | | | | |
| 2 | 72 | 240 | 900 | 3.0 | good | 80 | 4 | 0.75 | good |
| 3 | 60 | 470 | 1,200 | 0.96 | good | | | | |
| 4 | 30 | 240 | 800 | 1.41 | good | 80 | 3 | 0.47 | good |
| 5 | 60 | 450 | 1,000 | 1.20 | good | | | | |
| 6 | 60 | 450 | 1,200 | 1.0 | good | | | | |
| Compar. ex. 1 | 72 | 240 | 520 | 5.2 | limit | 80 | 4 | 1.30 | good |
| 2 | 144 | 240 | 300 | 18 | cannot be spun | | | | |
| 3 | 72 | 240 | 800 | 3.38 | limit | | | | |
| Ex. 7 | 20 × 2 | 470 | 1,000 | 0.77 | good | | | | |
| 8 | 72 × 2 | 60 | 300 | 72 | good | 80 | 4 | 18 | good |
| 9 | 20 × 2 | 240 | 1,200 | 1.25 | good | | | | |
| 10 | 30 × 2 | 470 | 800 | 1.44 | good | | | | |
| Compar. ex. 4 | 36 × 2 | 240 | 460 | 5.87 | limit | 100 | 4 | 1.47 | |
| 5 | 72 × 2 | 60 | 300 | 72 | good | 80 | 4 | 18 | good |

Table 3

(Non-woven fabric-making test)

| No. of examples of non-woven fabric | Raw material fibers | Adhesion temperature (°C.) | Metsuke (weight per unit area) ($g/m^2$) | Tensile strength (g) | Strength per Metsuke ($g \cdot m^2/g$) |
|---|---|---|---|---|---|
| 1 | Unstretched yarns of Example 2, 30% rayon 70% | 145 | 49.1 | 3,490 | 71.1 |
| 2 | Unstretched yarns of Example 2, 10% rayon 90% | 145 | 52.7 | 2,480 | 47.1 |
| 3 | Unstretched yarns of Example 4, 30% rayon 70% | 145 | 51.6 | 4,610 | 89.3 |
| 4 | Unstretched yarns of Example 6, 30% rayon 70% | 150 | 50.3 | 4,460 | 88.7 |
| 5 | Unstretched yarns of Example 5, 30% rayon 70% | 130 | 47.6 | 3,250 | 68.3 |
| 6 | Stretched yarns of Comparative example 1, 30% rayon 70% | 170 | 50.1 | 520 | 10.4 |
| 7 | Unstretched yarns of Example 9, 30% rayon 70% | 145 | 48.8 | 3,270 | 67.0 |
| 8 | Unstretched yarns of Example 10, 10% rayon 90% | 145 | 49.8 | 2,610 | 52.4 |
| 9 | Stretched yarns of Comparative example 4, 30% rayon 70% | 145 | 50.6 | 1,800 | 35.6 |
| 10 | Stretched yarns of Comparative example 4, 10% rayon 90% | 145 | 50.5 | 630 | 12.5 |

Table 4

| No. of paper-making examples | Paper-making examples: Blending proportion of paper material (%): Propylene polymer fibers or other polyolefin fibers | NBKP | Rayon | Physical properties of PP-mixed paper: Weight per unit area ($g/m^2$) | Tensile strength (kg/15 mm) | Breaking strength (km) | Peel strength (g/15 mm) Heat-seal condition*: 150° C. 0.5 sec | 200° C. 0.5 sec |
|---|---|---|---|---|---|---|---|---|
| 1 | Unstretched yarns of Example 4, 50 | 20 | 30 | 50.9 | 0.657 | 0.86 | 280 | 350 |
| 2 | Unstretched yarns of Example 5, 50 | 20 | 30 | 51.3 | 0.723 | 0.94 | 290 | 330 |
| 3 | Stretched yarns of Comparative Ex. 1, 50 | 20 | 30 | 49.6 | 0.551 | 0.74 | 0 | 210 |
| 4 | Unstretched yarns of Example 7, 50 | 50 | 0 | 50.1 | 0.947 | 1.26 | 270 | 330 |
| 5 | Unstretched yarns of Example 7, 60 | 20 | 20 | 48.2 | 0.571 | 0.79 | 350 | 390 |
| 6 | Stretched yarns of Comparative ex. 4, 50 | 20 | 30 | 51.0 | 0.581 | 0.76 | 180 | 230 |

*Pressing pressure, 2.8 $kg/cm^2$

What is claimed is:

1. Heat-melt adhesive fibers comprising a resin consisting of:
   (a) 50–100% of a crystalline propylene random terpolymer consisting of
      (1) 84–98% by weight of propylene,
      (2) 1–15% by weight of butene-1, and
      (3) 1–10% by weight of ethylene and
   (b) 0–50% by weight of a substantially non-crystalline ethylene-propylene random copolymer, said resin forming at least 50% of the cross-sectional circumference of said fibers.

2. Fibers according to claim 1 wherein said ethylene-propylene random copolymer of (b) contains 30–80% ethylene.

3. Fibers according to claim 1 wherein said fibers consist only of said resin.

4. Fibers according to claim 1 wherein said fibers have a composite structure consisting of said resin as a low melting component and a fiber-forming synthetic resin having a melting point at least 20° C. higher than that of said former resin, as a high melting component.

5. Fibers according to claim 4 wherein said composite structure is of side-by-side type and said high melting component is polypropylene.

6. Fibers according to claim 4 wherein said composite structure is of sheath-and-core type and said high melting component is polypropylene.

* * * * *